US010045612B2

(12) United States Patent
Freeman, Jr.

(10) Patent No.: US 10,045,612 B2
(45) Date of Patent: Aug. 14, 2018

(54) DUAL SURFACE, REVERSIBLE ERGONOMIC ACCESSORY FOR COMPUTER PERIPHERALS

(71) Applicant: INNOVATION PARKE LLC, Ridgefield, CT (US)

(72) Inventor: Robert P. Freeman, Jr., Ridgefield, CT (US)

(73) Assignee: INNOVATION PARKE LLC, Ridgefield, CT (US)

( * ) Notice: Subject to any disclaimer, the term of this patent is extended or adjusted under 35 U.S.C. 154(b) by 0 days.

(21) Appl. No.: 15/385,987

(22) Filed: Dec. 21, 2016

(65) Prior Publication Data

US 2017/0188700 A1 Jul. 6, 2017

Related U.S. Application Data

(60) Provisional application No. 62/274,283, filed on Jan. 2, 2016.

(51) Int. Cl.
*B68G 5/00* (2006.01)
*A47B 21/03* (2006.01)

(52) U.S. Cl.
CPC .. *A47B 21/0371* (2013.01); *A47B 2021/0385* (2013.01)

(58) Field of Classification Search
CPC ..... A47B 21/04; A47B 21/0371
(Continued)

(56) References Cited

U.S. PATENT DOCUMENTS 5,203,845 A 4/1993 Moore
5,492,298 A 2/1996 Walker
(Continued)

FOREIGN PATENT DOCUMENTS

CN 204790921 U 11/2015
DE 202013010286 U1 12/2013
(Continued)

OTHER PUBLICATIONS

"Workez Keyboard Tray", http://www.uncagedergonomics.com/workez-keyboard-tray/ (Accessed Jan. 29, 2016).
(Continued)

*Primary Examiner* — Todd M Epps
(74) *Attorney, Agent, or Firm* — Barlow, Josephs & Holmes, Ltd.

(57) ABSTRACT

An ergonomic computer accessory for use with hand operated computer peripherals, such as computer mice, touchpads or trackpads, comprising a base and two hinged, multi-angle, reversible, opposing surfaces, one for a working surface and the other for wrist support. During operation, the working surface is positioned so the user's hand is at a more natural angle to provide ergonomic benefits such as reducing muscular and skeletal strain on the user's hand and wrist. The opposing adjustable wrist support surface is oriented such that the user's wrist rests at an ergonomic angle without compressing the carpal tunnel on the flat surface of the wrist. Both the working surface and wrist support surface may be reversed to be oriented for either left and/or right handed users by flipping the base, wrist and working surfaces over to their appropriate positions. The base, wrist and support surfaces may be adjusted to lie flat for transporting the accessory.

20 Claims, 8 Drawing Sheets

(58) Field of Classification Search
USPC ..... 248/118; 361/679.19; 108/43
See application file for complete search history.

(56) References Cited

U.S. PATENT DOCUMENTS

| | | | | | |
|---|---|---|---|---|---|
| 5,562,270 | A | * | 10/1996 | Montague | A47B 21/0371 248/118.1 |
| 5,678,800 | A | * | 10/1997 | Markussen | G06F 3/0395 248/118 |
| 5,765,790 | A | | 6/1998 | Kuldvere | |
| 5,833,180 | A | | 11/1998 | Baranowski | |

FOREIGN PATENT DOCUMENTS

| | | | |
|---|---|---|---|
| KR | 20020094473 | A | 12/2002 |
| KR | 201315646 | | 6/2003 |
| KR | 20070042795 | | 4/2007 |

OTHER PUBLICATIONS

"Fully Adjustabile Keyboard Mouse Tray", http://www.wayfair.com/Cotytech-Fully-Adjustable-Keyboard-Mouse-Tray-KGB-5A-PGY1096.html (Accessed Jan. 29, 2016).
"Sidus Mouse Pad for Musculoskeletal Disorder Prevention", http://www.gobizkorea.com/catalog/product_view.jsp?blogld=wisemen71728tobjld=957093 (Accessed Jan. 29, 2016).

* cited by examiner

DUAL SURFACE, REVERSIBLE ERGONOMIC ACCESSORY FOR COMPUTER PERIPHERALS

CROSS-REFERENCE TO RELATED APPLICATION

This patent document claims priority to earlier filed U.S. Provisional Application Ser. No. 62/274,283, filed Jan. 2, 2016, the contents of which are incorporated herein by reference.

BACKGROUND OF THE INVENTION

1. Field of the Invention

This patent document relates generally to accessories for computer peripherals, such as input devices like mice and trackballs, for example, and more particularly to a dual surface, reversible, ergonomic accessory for computer peripherals that provides improved wrist support.

2. Background of the Related Art

Humans spend an increasing amount of time working with computers that require using peripheral devices such as computer mice or trackpads/touchpads.

However, the vast majority of computer peripherals were not designed with ergonomic use in mind. In some cases, the repeated use of these conventional computer peripherals may result in poor wrist posture, which, combined with prolonged repetitive use can lead to physical discomfort in the wrist, hand or forearm.

According to ergonomics researchers at Cornell University, our wrists are not meant to be positioned horizontally on a flat surface, such as a desktop, for prolonged periods.

The most common poor wrist position when using a computer mouse or trackpad/touchpad is referred to as "full pronation" or "pronated palm down position", which can create muscular and skeletal strain in the user's wrist and/or arm. The posture is unnatural in two ways: 1) wrist extension and 2) forearm pronation.

Full pronation/palm down is the worst position for your wrist to be in as it can cause increased musculoskeletal discomfort and risk of inflammation.

Users who position their wrists in this manner for prolonged periods may experience intermittent wrist discomfort, such as pins and needles sensations, pain or numbness. In some cases, the design of conventional computer mouse or trackpad peripherals may inadvertently cause the median nerve along the wrist to be compressed, which may result in symptoms of Carpal Tunnel Syndrome, a more serious disorder.

Cornell University researchers suggest that, instead of lying flat in a pronated position, the human wrist and forearm should be at an angle somewhere in between the "neutral rotation" (a position your hand would be in when your arms are resting at your sides) and "full pronation" or palm down.

Therefore, there is a need in the art for a device or method to provide additional ergonomic support to individuals that use computer peripherals for long periods of time.

SUMMARY OF THE INVENTION

The ergonomic support accessory solves the problems of the prior art by providing an ergonomic support accessory with two, fully adjustable, reversible, hinged, opposing ergonomically angled surfaces, one for a working surface for a computer peripheral and one for wrist support. The two angled surfaces may be reversed to be oriented for either left-handed or right-handed users.

The ergonomic support accessory combines the use of both angled surfaces to keep the user's hand and wrist in a natural posture while working with a computer mouse, computer trackpad/touchpad or other peripheral. The more natural angled position of the peripheral surface provides ergonomic benefits such as reducing the muscular and skeletal strain on the user's hand and wrist. The opposing surface provides wrist support at an angle and is specifically designed to avoid compressing the median nerve, reducing discomfort in the wrist.

The ergonomic support accessory allows the user to adjust the working surface and wrist support surface at any angle or lie the two surfaces flat with the base for easier transport of the device.

The ergonomic support accessory comprises a method and apparatus for providing ergonomic support to the user's hand and wrist for either a computer mouse, trackpad/touchpad or other computer peripheral device, such as an adding machine or calculator.

It is a general object to provide an ergonomic accessory that includes an ergonomically designed surface that will accommodate most computer peripheral devices, such as computer mice, trackpads, touchpads, etc.

It is a general object to provide an ergonomic support accessory that provides a surface made from a material or surface treatment with sufficient friction that keeps the computer peripheral from sliding off the working surface of the device.

It is a general object to provide an ergonomic support accessory that is able to be used by either left-handed or right-handed users.

It is a general object to provide a support ergonomic accessory having fully adjustable, opposing surfaces that may be oriented for left-handed and/or right-handed users at angles from approximately 170-160 and 10-20 degrees, respectively.

It is a general object to provide an ergonomic support accessory that allows the surfaces to be adjusted to a flat or close to flat position for storage and transport of the device.

BRIEF DESCRIPTION OF THE DRAWINGS

These and other features, aspects, and advantages of the ergonomic support accessory will become better understood with reference to the following description, appended claims, and accompanying drawings where:

DESCRIPTION OF THE PREFERRED EMBODIMENT

Figure 1:
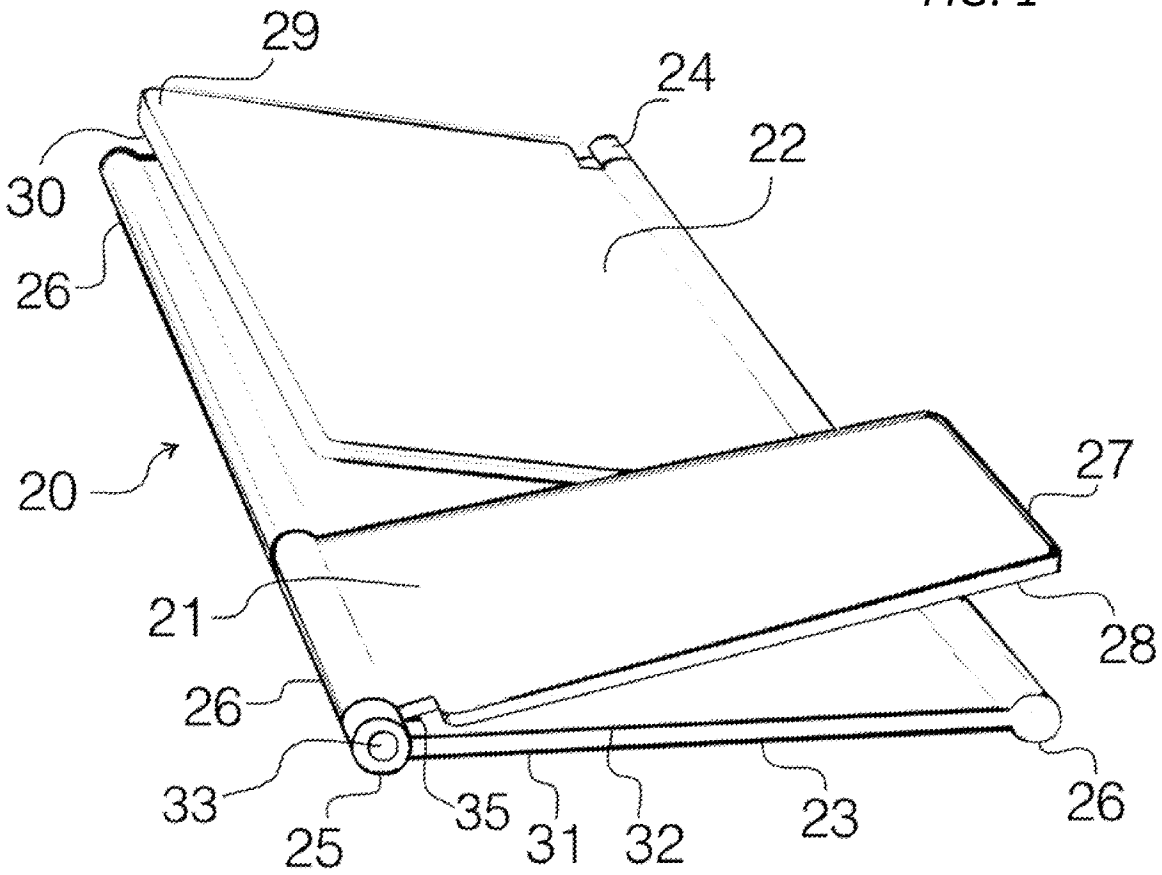
FIG. 1 shows an isometric view of the ergonomic support accessory oriented for right-handed users.

The reversible dual surface ergonomic computer accessory assembly 20 of the present invention is shown generally at 20 in FIGS. 1-6. The assembly 20 preferably includes an inclined working surface 22 for supporting the computer peripheral, such as a mouse 36, and a wrist support surface 21. The two inclined surfaces, the working surface 22 and the wrist support surface 21, are reversible via the hinges 24, 25, 26 incorporated into the base 23. During operation, a user places a computer peripheral, such as a computer mouse, on the working surface 22 and the user rests his or her wrist on the wrist support surface 21. The reversible dual surface ergonomic computer accessory 20 may be used by either a right-handed person or a left-handed person.

Referring to FIG. 1, when the reversible dual-surface ergonomic computer accessory 20 is oriented for a right-handed user, the working surface 22 forms an ergonomic angle of approximately 165 degrees and the wrist support surface 21 forms an ergonomic angle of approximately 15 degrees.

Figure 2:
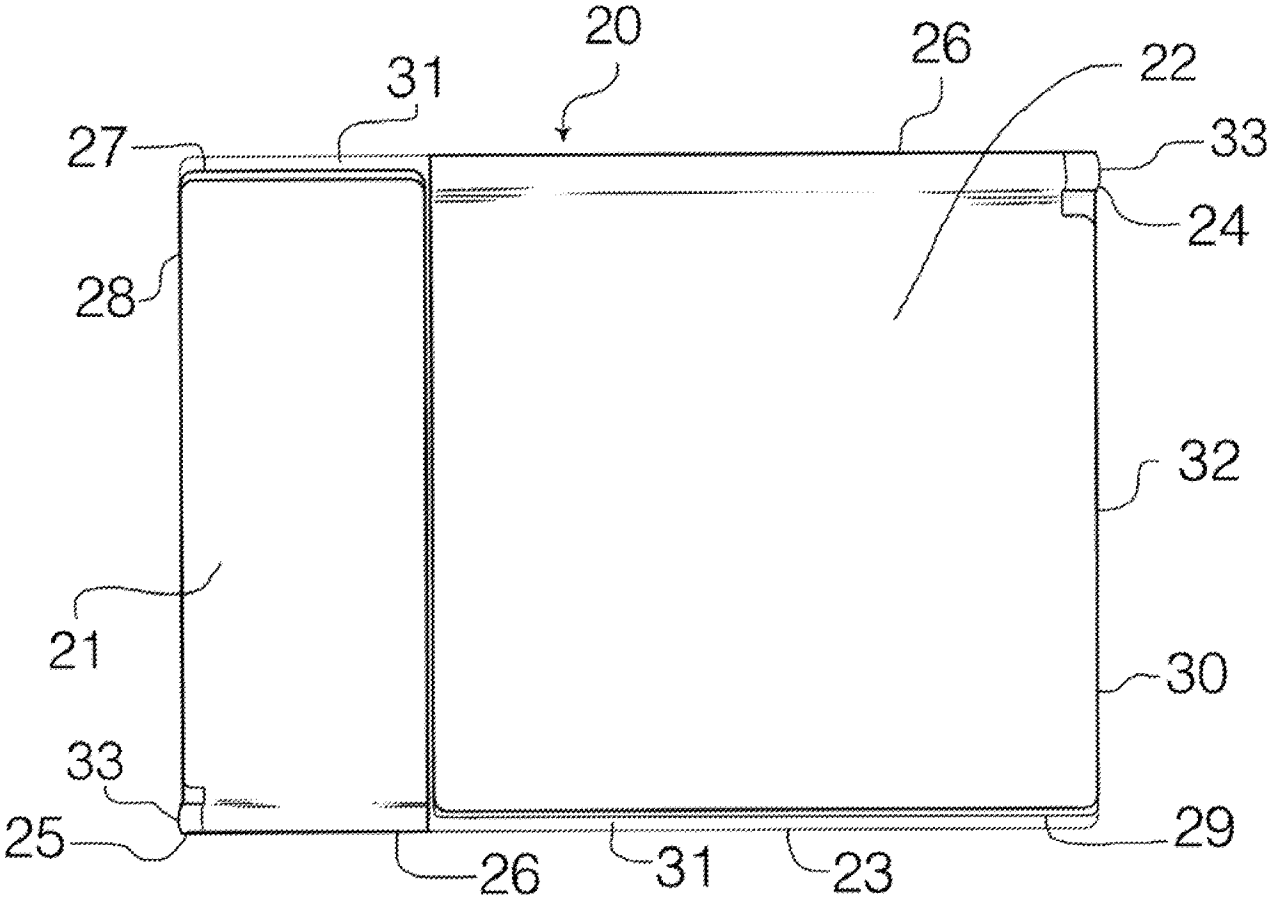
FIG. 2 shows a top view of the ergonomic support accessory oriented for left-handed users.
Figure 3:
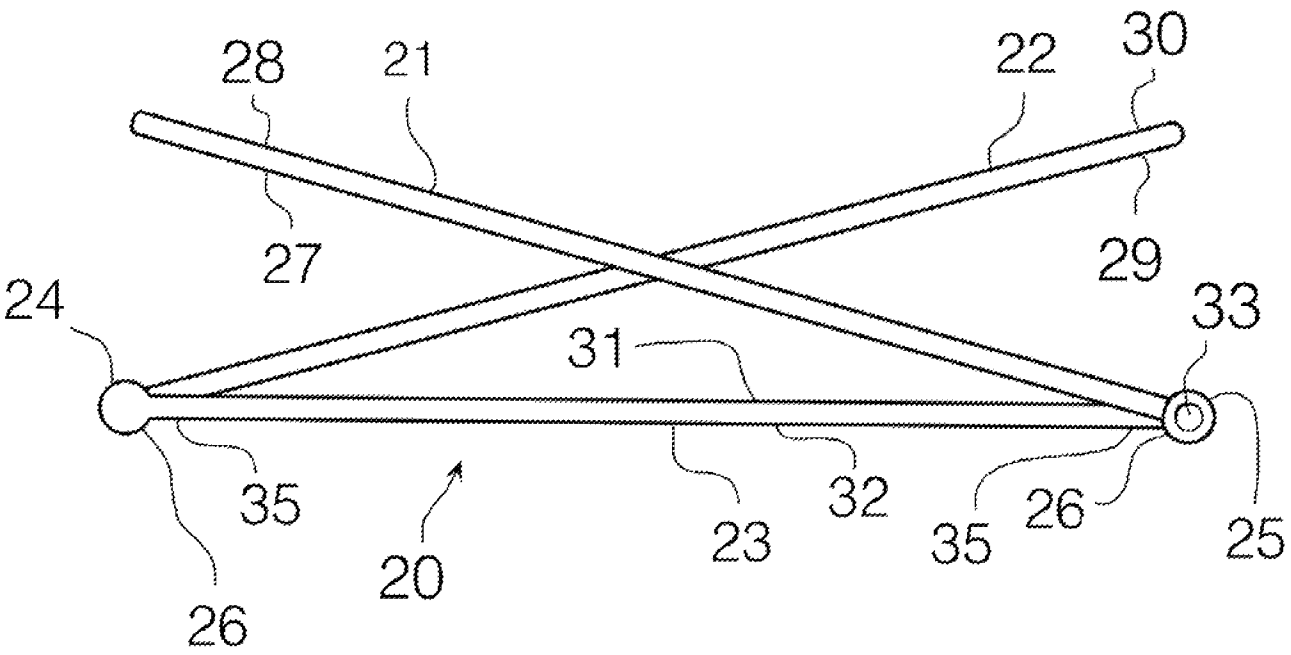
FIG. 3 shows an elevation view of the ergonomic support accessory oriented for left-handed users.

Referring to FIGS. 2-3, when the reversible dual-surface ergonomic computer accessory 20 is oriented for a left-handed user, the working surface 22 forms an ergonomic angle of approximately 15 degrees and the wrist support surface 21 forms an ergonomic angle of approximately 165 degrees.

Figure 4:
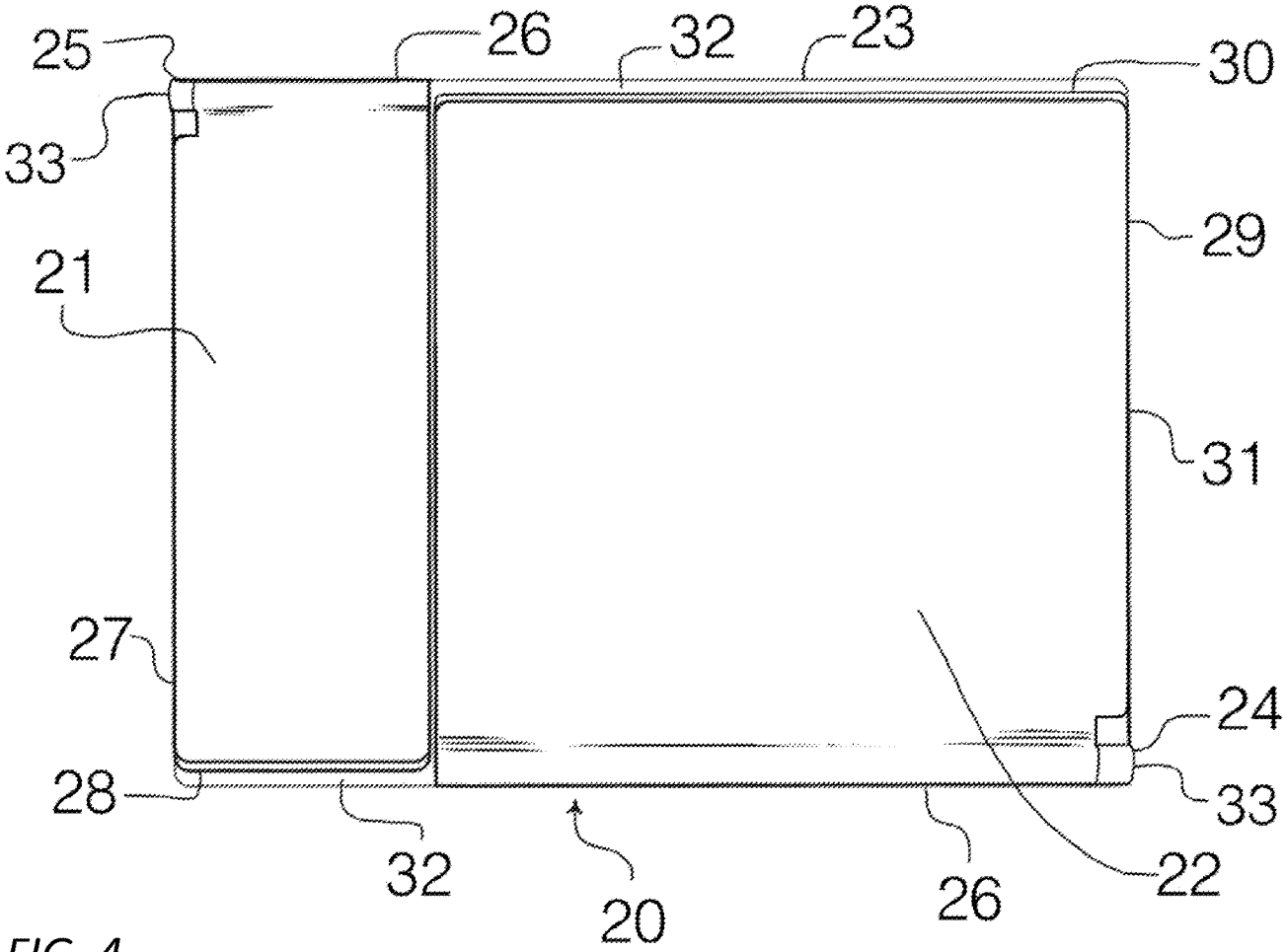
FIG. 4 shows a top view of the ergonomic support accessory oriented for right-handed users.
Figure 5:
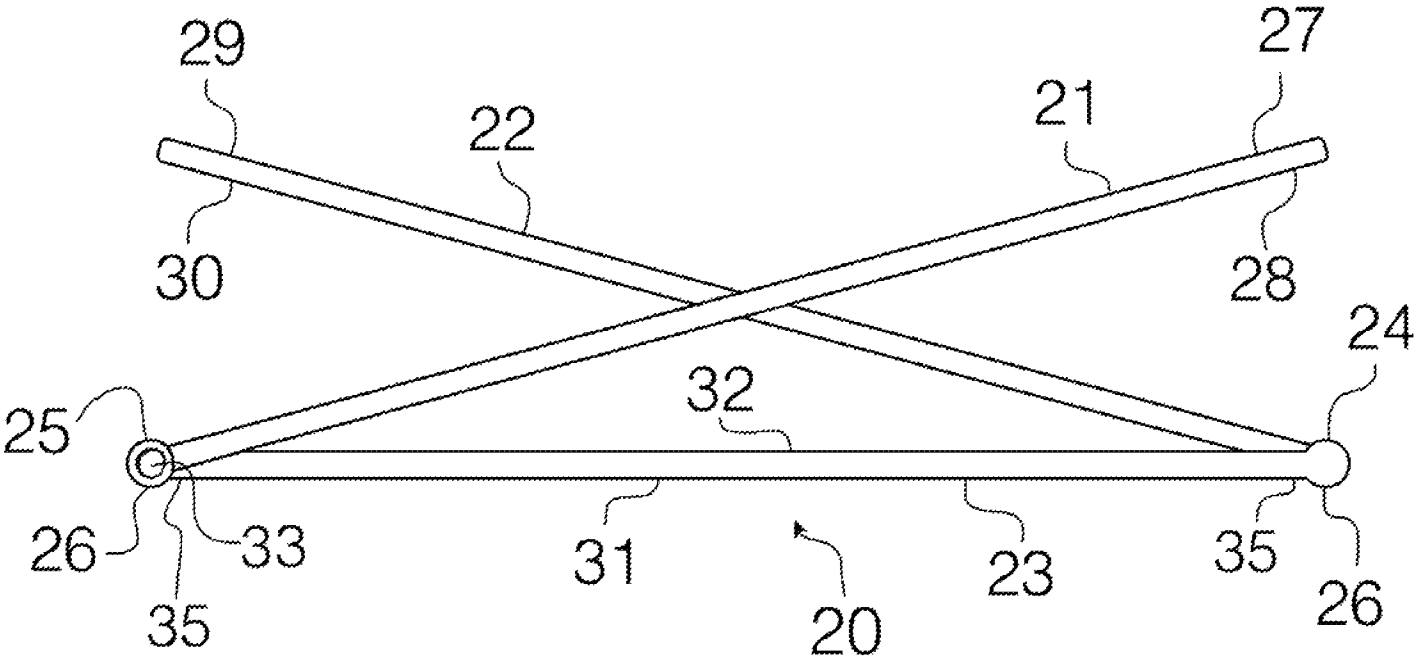
FIG. 5 shows an elevation view of the ergonomic support accessory oriented for right-handed users.

Referring to FIG. 4-5, when the reversible dual-surface ergonomic computer accessory 20 is oriented for a right-handed user, the working surface 22 forms an ergonomic angle of approximately 165 degrees and the wrist support surface 21 forms an ergonomic angle of approximately 15 degrees.

Figure 6:
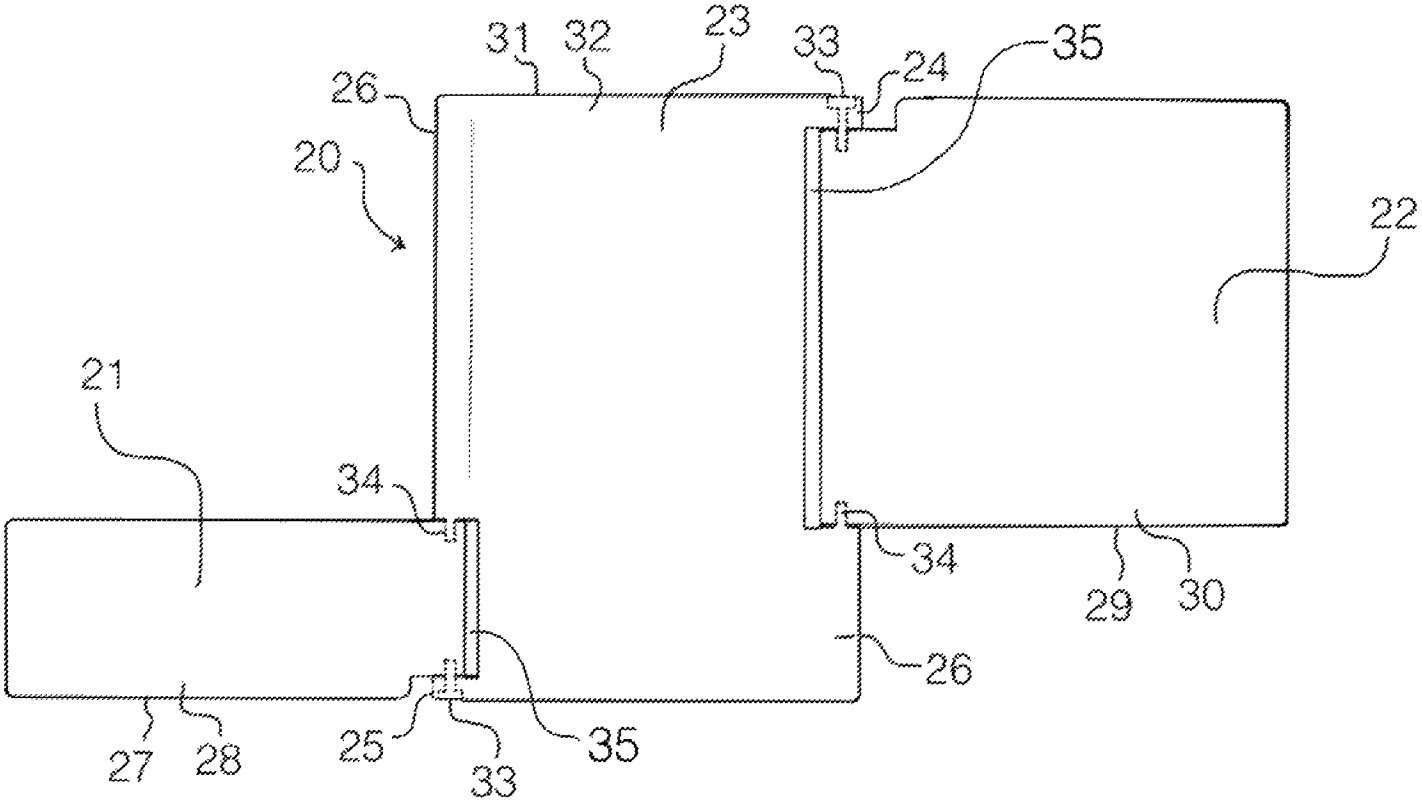
FIG. 6 shows a top view, with partial cross-section of the ergonomic support accessory when open flat on a desktop or other surface, showing the internal hinge structures, including the set screws and pins.

Referring to FIG. 6, the accessory 20 is open flat such that the base 23 is in the middle and the working surface 22 is at a 0 degree angle on the right side of the base 23 and the wrist support surface 21 is at a 180 degree angle on the left of the base 23. Locking inset screws 33 and base pins 34 hold the working surface 22 and wrist support surface 21 in place. The cutout gaps 35 in the base 23 are visible.

The locking inset screws 33 and base pins 34 allow pivotal movement of the working surface 22 and wrist support surface 21 about the base 23, thus forming a hinge-like movement between the support surfaces 21, 22 and base 23, respectively. Because the "hinge action" or pivotal movement of the support surfaces 21, 22 is in-line with the base 23, the support surfaces 21, 22, will not fully close against or fully contact the base 23. The thickness of the support surfaces 21, 22 contacts the base 23 near the hinge and props the support surfaces 21, 22 open at an angle determined by the thickness of the materials of the base 23 and support surface 21, 22 and the width of gap 35. By manufacturing the support surfaces 21, 22 and base 23 of a particular thickness with a gap 35 of a particular width, the desired angles of the support surfaces 21, 22 relative to the base 23 may be achieved. Selective thinning and thickening of portions of the support surfaces 21, 22 and base 23, and width of the gap 35, may also be used. The support surfaces 21, 22 and base 23 need not have a uniform thickness or substantially uniform thickness.

Figure 7:
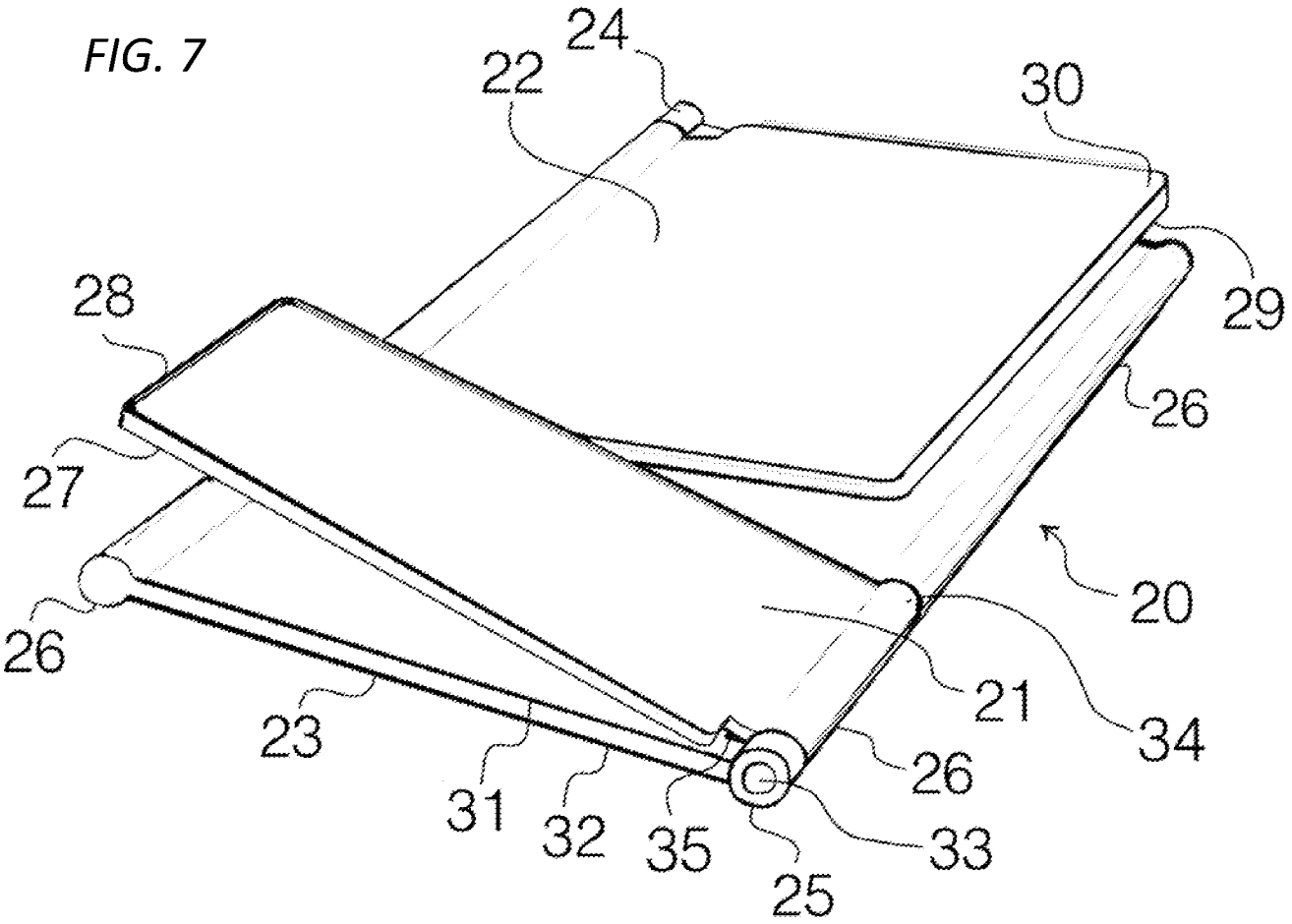
FIG. 7 shows an isometric view of the assembly of the present invention oriented for left-handed users.

Referring to FIG. 7, when the reversible dual surface ergonomic computer accessory 20 is oriented for a left-handed user, the working surface 22 forms an ergonomic angle of approximately 15 degrees and the wrist support surface 21 forms an ergonomic angle of approximately 165 degrees.

Figure 8:
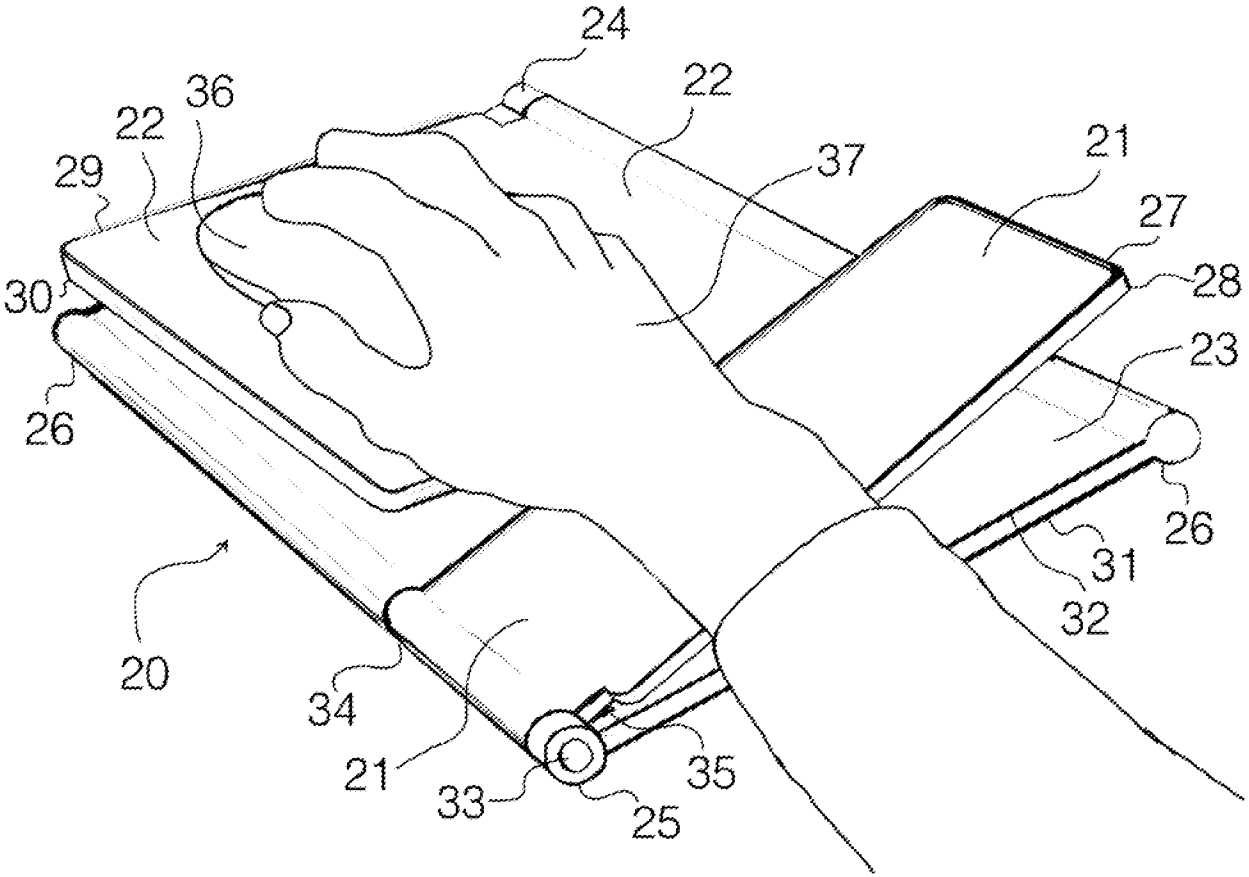
FIG. 8 shows an isometric view of the ergonomic support accessory, oriented for a right-handed user, with a person's right hand operating a computer mouse thereon.

Referring to FIG. 8, the accessory 20 is configured for use by a right-handed person. A right-handed user would rotate the working surface 22 counterclockwise to an angle of perhaps 170-160 degrees and rotate the wrist support surface 21 counter clockwise to an angle of perhaps 10-20 degrees.

The user's right hand is positioned on the top of the wireless computer mouse 36 on the working surface 22. The user moves the computer mouse 36 forward, backward, rightward or leftward on the working surface 22 to cause a corresponding movement of the cursor or pointer on the computer screen display (not shown).

The user's wrist is supported by the wrist support surface 21 at an angle that does not compress the carpal tunnel, and, therefore, reduces the risk of injury or pain from prolonged use of the computer peripheral 36.

It should be noted that the user may also position wrist support surface 21 at an "open" angle if he or she does not wish to use the wrist support surface 21, while still using the working surface 22, though this is not generally recommended as the user's wrist may be more likely to rest on an abrupt edge of the working surface 22.

The base 23 has a rectangular or squarish shape and support surfaces near hinge 26 that comprise a non-skid material so that the base 23 does not slip on a table or desktop when being used.

The base 23, working surface 22 and wrist support surface 21 may be made of plastic, metal, wood, or any other material that can provide the structure described and be manufactured.

The working surface 22 comprises a nonskid material or treatment to provide enough friction to keep the computer peripheral device, such as a computer mouse, trackpad or touchpad will not slide easily down the working surface 22 when the user removes his or her grip from the peripheral. The wrist support surface 21 and/or working surface 22 may be made of, or covered with, a flexible and soft, yet resilient material, such as neoprene.

In addition to the features and advantaged discussed above, the invention accommodates use with equal benefit by people having hands, wrists and arms of varying sizes. More specifically, each user can rotate the dual surface, ergonomic accessory 20 any desired amount in relation to his or her wrist, hand or arm for maximum comfort to ensure that the user's hand is in the most comfortable position to relieve fatigue.

Therefore, it can be seen that the present invention provides a unique solution to the problem of preventing and reducing wrist and hand injuries in user's that operate computer peripherals for long repetitive periods, by providing an ergonomic support accessory that positions the user's hand between a neutral position and a full pronation position, thereby reducing compression on sensitive nerves and tendons. Furthermore, the pivoting working surface wrist support surface permit the ergonomic support accessory to be easily reversible for both left and right handed users.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An ergonomic support accessory for computer peripherals, comprising:

a base having a first side and a second side opposite the first side;

a working surface pivotally connected to the first side of the base, the working surface supported at an incline relative to the base; and a wrist support surface pivotally connected to the second side of the base, the wrist support surface supported at an incline relative to the base;

whereby the working surface and wrist support surface slope in opposite directions relative to the base.

2. The accessory of claim 1, wherein the wrist support surface is supported at an angle of 10° to 20° relative to the base.

3. The accessory of claim 2, wherein the working surface is supported at an angle of 160° to 170° relative to the base.

4. The accessory of claim 2, wherein the wrist support surface is supported at an angle of 15° relative to the base.

5. The accessory of claim 4, wherein the working surface is supported at an angle of 160° to 165° relative to the base.

6. The accessory of claim 1, wherein the wrist support surface is supported at an angle of 160° to 170° relative to the base.

7. The accessory of claim 6, wherein the working surface is supported at an angle of 10° to 20° relative to the base.

8. The accessory of claim 6, wherein the wrist support surface is supported at an angle of 165° relative to the base.

9. The accessory of claim 8, wherein the working surface is supported at an angle of 15° relative to the base.

10. The accessory of claim 1, the working surface is pivotally connected to the base via a first hinge.

11. The accessory of claim 10, wherein the first hinge comprises an inset screw and base pin configured to allow pivotal movement and support the working surface at an incline relative to the base.

12. The accessory of claim 1, the wrist support surface is pivotally connected to the base via a second hinge.

13. The accessory of claim 12, wherein the second hinge comprises an inset screw and base pin configured to allow pivotal movement and support the wrist support surface at an incline relative to the base.

14. The accessory of claim 1, wherein the base has a rectangular shape.

15. The accessory of claim 1, wherein the base includes a first surface and a second surface opposite the first surface wherein, the first surface and second surface alternatively configured for placement on a support surface.

16. The accessory of claim 15, wherein the wrist support surface may be pivoted about the base to oppose one of the first surface or the second surface of the base.

17. The accessory of claim 15, wherein the working surface may be pivoted about the base to oppose one of the first surface or the second surface of the base.

18. The accessory of claim 1, wherein the working surface and the wrist support surface comprise a non-skid material.

19. The accessory of claim 1, wherein the working surface and the wrist support surface comprise flexible, soft material.

20. The accessory of claim 19, wherein the flexible, soft material comprises neoprene.

* * * * *